US006363899B1

(12) United States Patent
Koelle et al.

(10) Patent No.: US 6,363,899 B1
(45) Date of Patent: Apr. 2, 2002

(54) METHOD FOR THE STARTER CUT-OUT OF AN INTERNAL COMBUSTION ENGINE

(75) Inventors: Gerhard Koelle, Wiernsheim; Manfred Ackermann, Oppenweiler, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/446,467

(22) PCT Filed: Jul. 1, 1998

(86) PCT No.: PCT/DE98/01815

§ 371 Date: Dec. 20, 1999

§ 102(e) Date: Dec. 20, 1999

(87) PCT Pub. No.: WO00/01943

PCT Pub. Date: Jan. 13, 2000

(51) Int. Cl.[7] ..... F02N 11/08
(52) U.S. Cl. ..... 123/179.3; 290/38 R
(58) Field of Search ..... 123/179.3, 179.2, 123/179.4; 290/38 R, 38 C

(56) References Cited

U.S. PATENT DOCUMENTS 5,905,315 A * 5/1999 Lefebvre et al. ..... 123/179.3
5,934,237 A * 8/1999 Vilou ..... 123/179.3
5,970,936 A * 10/1999 Cabrera et al. ..... 123/179.3

* cited by examiner

*Primary Examiner*—Andrew M. Dolinar
(74) *Attorney, Agent, or Firm*—Michael J. Striker

(57) ABSTRACT

The invention is directed to a method for turning off the starter of an internal combustion engine, wherein a starter motor which can be engaged with the internal combustion engine for cranking is disengaged and switched off when the internal combustion engine runs by itself, and the time at which the starter is switched off is determined from a curve of a starter current of the starter motor. It is provided that a signal proportional to the starter current ($I_S$) is evaluated for determining the time ($t_A$) for switching off the starter, wherein there is an evaluation of a characteristic line with a signal which is proportional to the starter current, which characteristic line is dependent on an operating state of the internal combustion engine.

8 Claims, 3 Drawing Sheets

METHOD FOR THE STARTER CUT-OUT OF AN INTERNAL COMBUSTION ENGINE

BACKGROUND OF THE INVENTION

The invention is directed to a method for turning off a starter of an internal combustion engine.

It is known that internal combustion engines must be started by means of a starting mechanism because they cannot start by themselves. Starter motors are usually used for this purpose. These starter motors are connected with a voltage and source via a starter relay constructed as an engagement relay, as they are called, and a pinion of the starter motor is simultaneously engaged with a toothed rim of a flywheel of the internal combustion engine for cranking. In order to switch on the starter relay, it is known to control this starter relay by means of an external switch, for example, an ignition switch or starter switch of the motor vehicle. After the internal combustion engine has begun to run independently, the starter motor must be disengaged to prevent noise and wear. It is known to switch off the starter manually by releasing the ignition switch or starter switch. Solutions for turning off the starter of the internal combustion engine automatically for increased convenience in motor vehicles are known. For example, it is suggested in DE 195 03 537 A1 to detect autonomous running of the internal combustion engine automatically by detecting the ripple of a battery voltage or a starter current. The absolute value of the battery voltage or starter current is compared with a reference value in order to detect independent running of the internal combustion engine. In this connection, it is disadvantageous that operating conditions of the internal combustion engine can be taken into account only insufficiently, so that a cold start and warm start of the internal combustion engine, for example, cannot be taken into account.

SUMMARY OF THE INVENTION

The method according to the invention offers the advantage that information about the operating state of the internal combustion engine can be taken into account indirectly for determining the time to switch off the starter. Due to the fact that a signal proportional to the starter current is evaluated for determining the time to switch off the starter, wherein there is an evaluation of a characteristic line with a signal which is proportional to the starter current, which characteristic line is dependent on the operating state of the internal combustion engine, it is possible to switch off the starter in an optimum manner immediately after the internal combustion engine has begun to run independently, so that starting time is reduced especially when the internal combustion engine is at operating temperature. The method can be used in a simple manner for all internal combustion engines, wherein it is only necessary to adapt that characteristic lines of the parameters determined by the operating state of the internal combustion engine.

In a preferred construction of the invention, a battery voltage of a motor vehicle battery supplying the starter motor is evaluated as a signal proportional to the starter current. In this way, it is possible to optimize the time for switching off the starter without information about the rate of rotation of a crankshaft of the internal combustion engine.

DRAWINGS

The invention will be described more fully in the following in embodiment examples with reference to the accompanying drawings.

DESCRIPTION OF THE PREFERRED EMBODIMENTS

Figure 1:
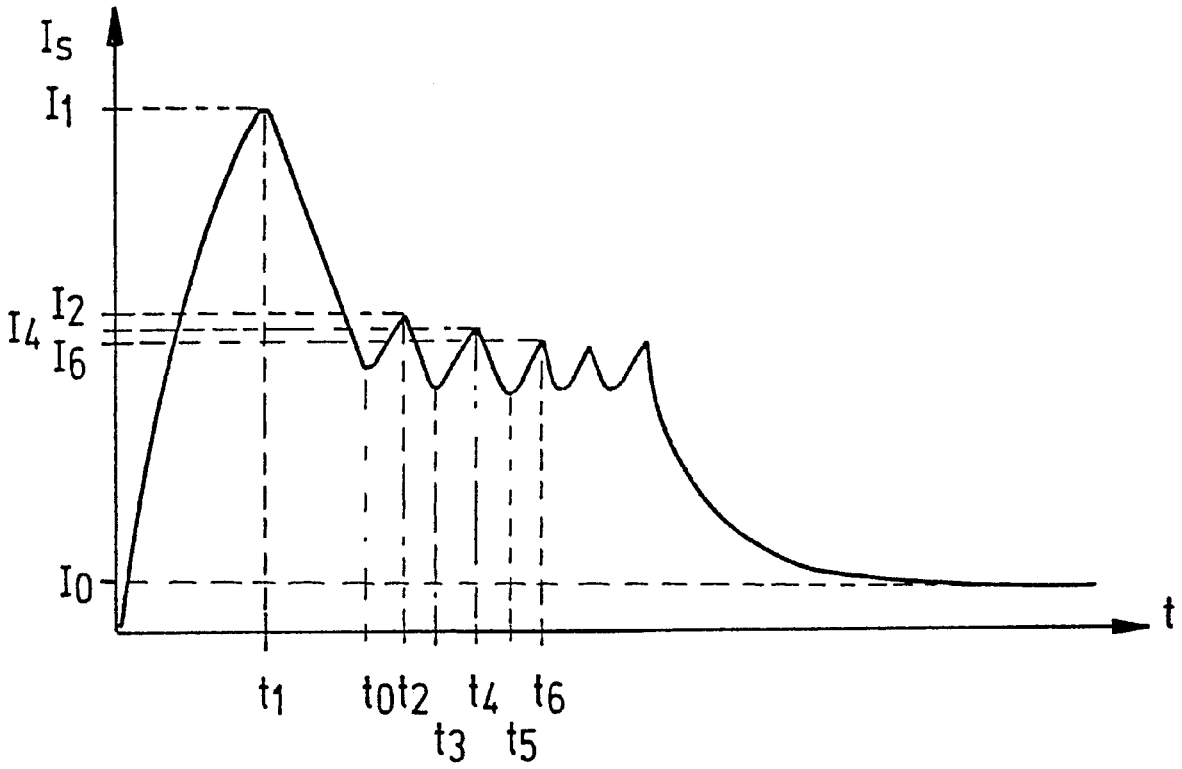
FIG. 1 shows the curve of a starter current.

FIG. 1 shows a typical curve of a starter $I_S$ of a starter motor of an internal combustion engine over time t. When the starter motor is switched on, the starter current $I_S$ climbs to a first maximum value $I_1$ at time $t_1$. The starter current $I_S$ then passes into a ripple area before reaching a current $I_0$ when the internal combustion engine begins to run by itself. As is known, the ripple of the starter current $I_S$ results from the alternating compression and decompression phases of the internal combustion engine during the starting phase. Proceeding from time $t_0$, which represents which represents a defined distance from time $t_1$, e.g., 150 ms, the phase with positive and negative slopes of the starter current $I_S$ are detected. In the example shown in the drawing, the phases with a negative slope of the starter current are detected through time periods $t_2$ to $t_3$, $t_4$ to $t_5$, and so on, while the phases of positive slope are detected by time periods $t_3$ to $t_4$ and $t_5$ to $t_6$, and so on. A voltage minimum at times $t_2$, $t_4$ and $t_6$ is associated with each starter current maximum $I_2$, $I_4$ and $I_6$.

In order to determine the time for switching off the starter, the period of the starter current with negative gradient is determined proceeding from each maximum of the starter current $I_2$, $I_4$ and $I_6$ and is compared with a permanently stored time characteristic. The permanently stored time characteristic is determined from a function $t_{switch\text{-}off}=f(I_1)$. Information can be derived about the operating state of the internal combustion engine based on the first current maximum $I_1$. Accordingly, it is known that, at different operating temperatures of the internal combustion engine, the first maximum $I_1$ has a corresponding value that can be assigned to these operating features.

Figure 2:
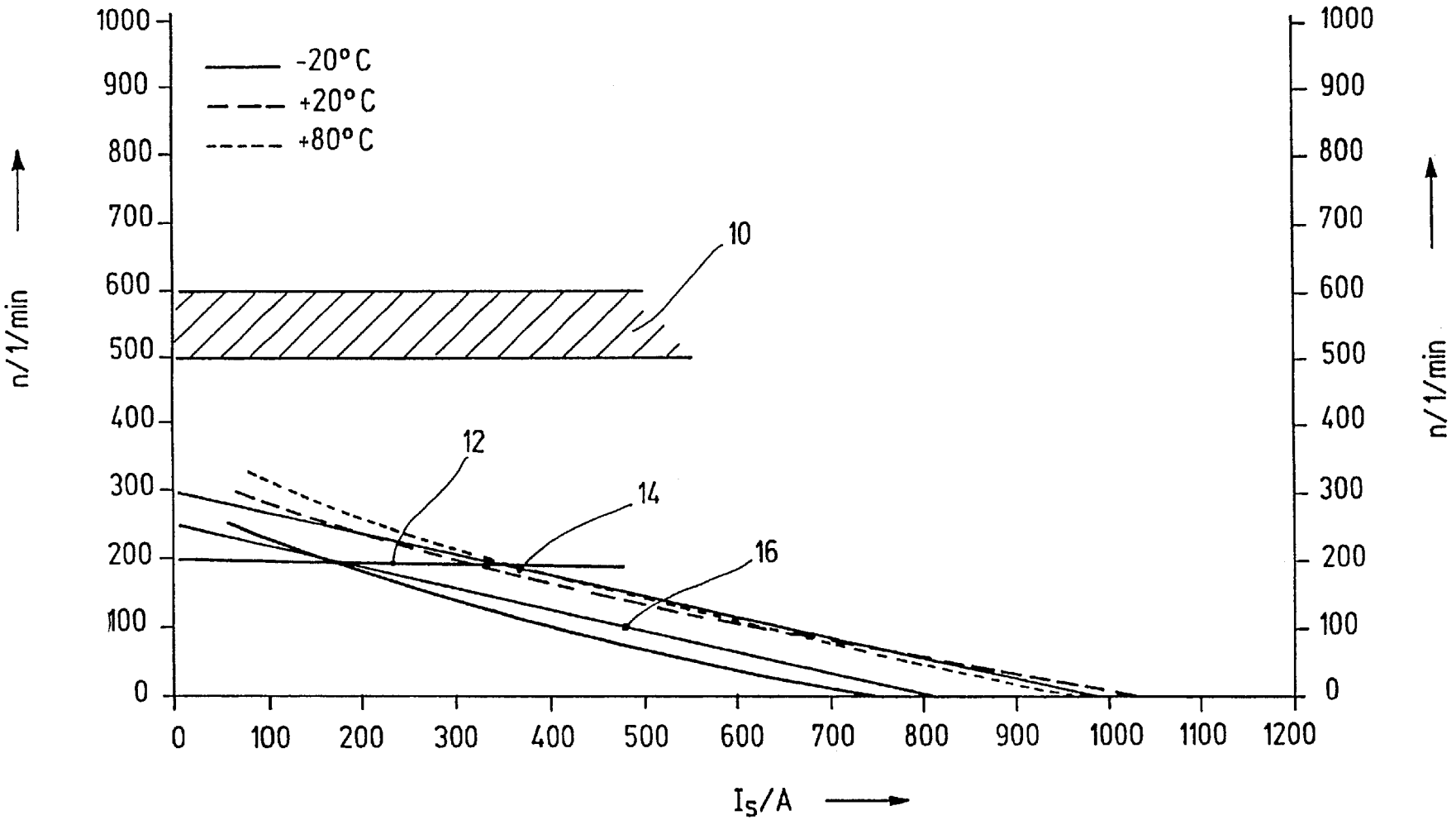
FIG. 2 shows correlations between the starter current and a crankshaft rotational speed of an internal combustion engine.

This information is further evaluated based on the correlation, shown in FIG. 2, between a crankshaft rotational speed of the internal combustion engine and the starter current $I_S$. The characteristic lines in FIG. 2 represent the correlation of a crankshaft rotational speed n to the starter current $I_S$. In this connection, a closed overrunning clutch and a quasi-stationary operation of the starter motor and internal combustion engine are assumed. A total of three characteristic lines are plotted for three different operating temperatures, namely, −20°, +20° C. and +80° C. A range defining the end range of run-up support of the starter in the case of a cold internal combustion engine is designated by 10. A characteristic line 12 defines a minimum crankshaft rotational speed n for independent running in a warm internal combustion engine. The resulting characteristic lines of the crankshaft rotational speed n over the starter current $I_S$ are changed into linearized characteristic lines. A "warm" characteristic line is designated by 14 and a "cold" characteristic line running parallel thereto is designated by 16. A good correlation between the starter current $I_S$ and rotational speed n results for temperatures greater than approximately 10° C. and for a rotational speed range n up to about 300 1/min. A switch-off criterion can be determined from this for a warm-operating internal combustion engine when no ignition failure or misfiring occurs. There is no intersection between the minimum required rate of rotation n and the starter current $I_S$ for temperatures less than 0° C.

By evaluating the current-time values for the starter current $I_S$ given in accordance with FIG. 1 with rotational speed/current relationship shown in FIG. 2, a time characteristic is formed for switching off the starter of the internal combustion engine. In so doing, different time characteristic lines for different operating states of the internal combustion engine, e.g., depending on operating temperature, are stored and processed. By defining an initial temperature $T_{crit}$ of, e.g., 10° C., characteristic lines greater than $T_{crit}$ can be distinguished from characteristic lines less than $T_{crit}$. Switching between these characteristic lines is carried out by evaluation of the current maxima $I_1$, $I_2$ of the starter current $I_S$, for example, since they supply information about whether the internal combustion engine is cold or at operating temperature. In particular, a criterion for detecting a warm internal combustion engine or a cold internal combustion engine can be the amplitude of the maxima $I_1$ and $I_2$, the time interval between amplitudes $t_2-t_1$ and the difference $I_2-I_1$.

For purposes of simplification, the time point for switching off the starter can be determined based on a common characteristic line, wherein, for example, a common characteristic line is used for a warm internal combustion engine and a cold internal combustion engine.

In order to switch off the starter after the internal combustion engine has safely begun running independently, switching off must be carried out over the time period of the open overrunning clutch. The open overrunning clutch can be detected via the curve of the starter current $I_S$. The shortest observation period which must pass before the starter can be switched off with open overrunning clutch corresponds to the time period required for 0.8 to 1 half-revolution of the crankshaft at an unchanged rotational speed n without combustion torque corresponding to the ignition interval in a 4-cylinder internal combustion engine. The factor 0.8 is given because, when the internal combustion engine and countershaft starter motor are warm, the frictional engagement phase with closed overrunning clutch does not drop below approximately 20% of the cycle time of the internal combustion engine.

The rate of rotation n can be determined via the closed phase of the overrunning clutch preceding an open phase of the overrunning clutch according to the correlation between the starter current $I_S$ and the crankshaft rotational speed n (warm characteristic line). At temperatures appreciably below +20° C. and/or when the motor vehicle battery is partly discharged, a correspondingly slower correlated rotational speed value n is given at the same starter current $I_S$. This is compensated at lower temperatures of the internal combustion engine in that the relative frictional engagement phase typically climbs to 50% at 0° C. or to 70% at −20° C. When the factor of 0.8 is also retained in this instance, an opening phase of the overrunning clutch is likewise safely covered at negative temperatures. At cold temperatures, a cold internal combustion engine can be clearly detected, at the latest, from the second compression phase by means of the high current level of the starter current $I_S$ and a slight reduction between the current maxima $I_1$ and $I_2$, so that a longer waiting period, i.e., a correspondingly different time characteristic, can be switched to. This results in the advantage that misfiring (up to a certain degree) does not result in a stopping of the internal combustion engine when the starter of the internal combustion engine is switched off. If necessary, a longer delay time can be adjusted in the case of an open overrunning clutch in order to cover at least one complete combustion misfire at the time characteristic.

On the whole, the starter current $I_S$ is evaluated by discounting a preliminary phase leading up to time $t_0$ after the connection of the starter motor with the voltage source (motor vehicle battery). The gradients of the starter current $I_S$ are then continuously evaluated in that the current maxima $I_2$, $I_4$, $I_6$ . . . are formed at the end of each phase with a positive slope. Over the time characteristics following a negative slope of the starter current $I_S$, these values form a delay time up to which the negative slope of the starter current $I_S$ must remain unchanged in order to initiate the switching off of the starter. In this connection, the function $T_{switch\text{-}off}=f_1(I_1)$ is applicable for determining the warm or cold characteristics. After the second complete compression phase, it is decided by means of two current maxima $I_2-I_4$, $I_4-I_6$, . . . at the end of each phase with a positive current gradient whether the temperature of the internal combustion engine is greater than or less than 0° C. At a low temperature, the time characteristic switches to $T_{switch\text{-}off}=f_2(I_1)$. In this way, no switching off of the starter is carried out when the internal combustion engine is cold (large values of starter current $I_S$). At the same time, the delay time at a lower starter current $I_S$ (higher temperature of internal combustion engine) is automatically reduced via the stored characteristic, so that an excessively high rotational speed value n at a higher temperature of the internal combustion engine is prevented at the switch-off time.

The characteristic lines 14 and 16 shown in FIG. 2 can be determined in the following manner.

Examples of calculations of the application-dependent delay time:

The simplified (linearized) "warm characteristic" according to FIG. 2 is:

$Nkw_{warm}$=NkwI*(1.−$I_1$/Iwk) NkwI=300 1/min

Iwk=1000 A

A straight line shifted in parallel applies for the "cold characteristic" in a simplified manner:

$Nkw_{cold}$=$Nkw_{warm}$−50 1/min

The following applies for the delay time (twindow) depending on the crankshaft rotational speed:

twindow=120.*factor/(Nkw*Nzz) Nzz=4; cylinder number factor=0.8; see above.

twindow=24./Nkk

The rotational speeds and waiting periods for the warm and cold internal combustion engine determined according to these (linearized) formulas are compiled in the following table:

| $I_1$/A | Nkwwarm 1/min | Nkwcold 1/min | twinwarm/ms | twincold/ms |
|---|---|---|---|---|
| 100 | 270 | 220 | 89 | 109 |
| 200 | 240 | 190 | 100 | 126 |
| 300 | 210 | 160 | 114 | 150 |
| 400 | 180 | 130 | 133 | 185 |
| 500 | 150 | 100 | 160 | 240 |
| 600 | 120 | 70 | 200 | 343 |
| 700 | 90 | 40 | 267 | 600 |
| 800 | 60 | 10 | 400 | 2400 |

where $I_1$ [A] represents the current maximum at the start of a dropping current curve,
Nkwwarm [1/min] represents the estimated warm rotational speed,
Nkwcold [1/min] represents the estimated cold rotational speed,
Twinwarm [ms] represents the minimum delay time when the internal combustion engine is warm, and
Twincold [ms] represents the minimum delay time when the internal combustion engine is cold.

Figure 3:
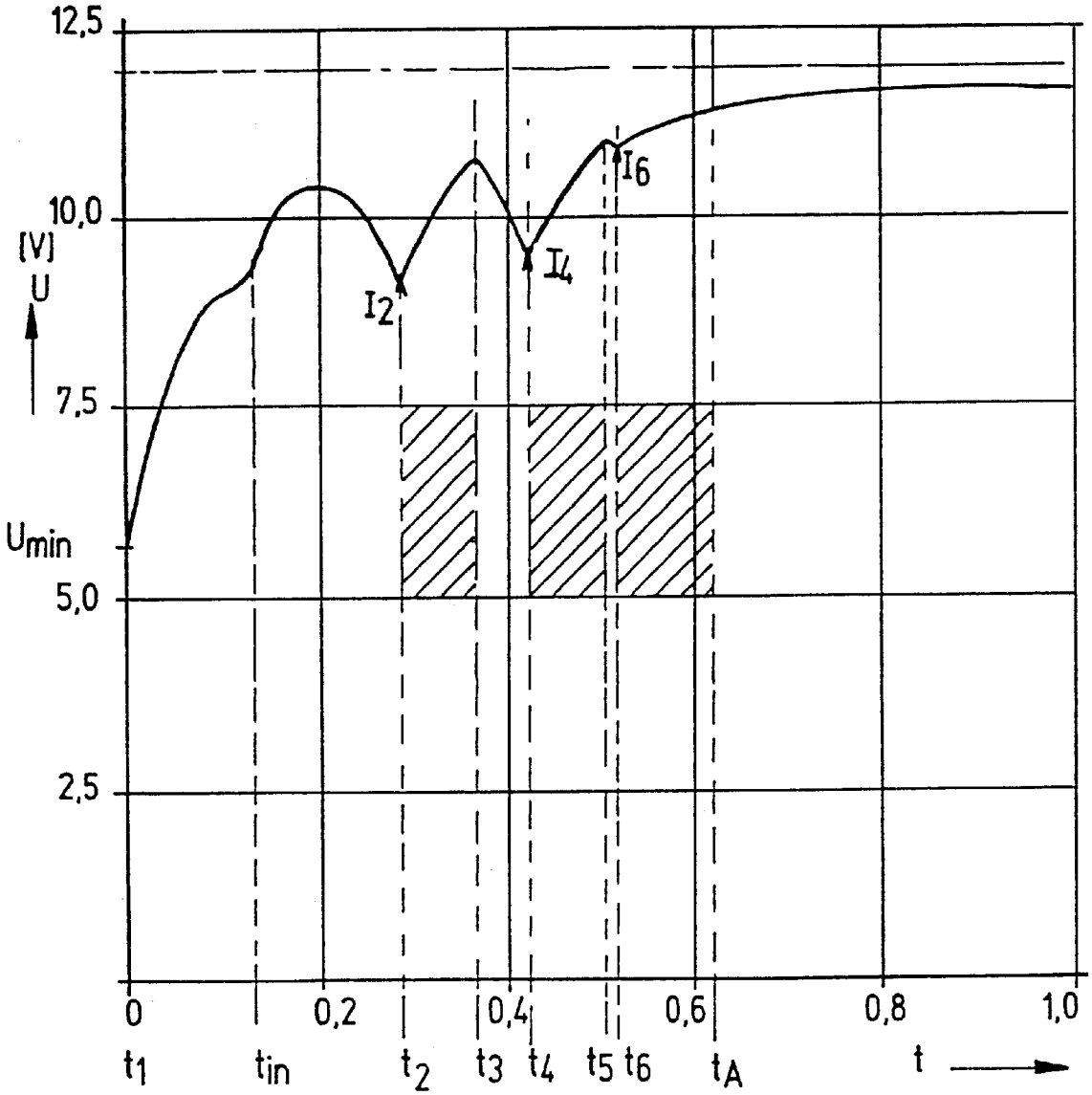
FIG. 3 shows the battery voltage curve during a starting phase.

With reference to FIG. 3, another method for switching off the starter of an internal combustion engine is described, wherein, instead of the starter current $I_S$, the motor vehicle battery voltage U is used as a signal proportional to the starter current. The curve of the voltage U (battery voltage) behaves in a mirror-inverted manner with respect to the starter current $I_S$ during the starting process of the internal combustion engine. The voltage U has a ripple which is opposed by the ripple of the starter current $I_S$, that is, the voltage U falls during segments with rising starter current $I_S$ and the voltage U rises in segments with falling starter current $I_S$. In order to illustrate this, times $t_2$, $t_4$ and $t_6$ are plotted with currents $I_2$, $I_4$ and $I_6$ in FIG. 3. The voltage U is tapped at a terminal of the starter motor which is connected with the positive pole of the vehicle battery. In this case, the following equation applies:

$$U=U_{Batt}-I_S(Ri_{Batt}+Ri_L),$$

where $U_{Batt}$ represents the no-load voltage of the motor vehicle battery, $I_S$ is the starter current, $Ri_{Batt}$ is the internal resistance of the motor vehicle battery, and $Ri_L$ is the line resistance from the connection terminal to the motor vehicle battery.

The internal resistance of the battery $Ri_{Batt}$ and the no-load voltage $U_{Batt}$ are fundamentally dependent on the vehicle battery that is used, on the temperature and on the charge state. The relationship which is nonlinear on the whole is given by the following table, where the no-load voltage $U_{Batt}$ is given in volts and the internal resistance of the battery $Ri_{Batt}$ is given in milliohms:

| Battery charge state<br>Temperature | 0% | 80% | 50% |
|---|---|---|---|
| +20° C. | 12.00/5.00 | 11.76/5.45 | 11.51/6.14 |
| 0° C. | 11.69/5.75 | 11.43/6.24 | 11.17/6.88 |
| −10° C. | 11.54/6.46 | 11.27/6.90 | 11.00/7.60 |
| −20° C. | 11.38/7.56 | 11.11/8.07 | 10.83/8.65 |

For temperatures greater than 20° C., the internal resistance of the battery $Ri_{Batt}$ falls somewhat and the no-load voltage $U_{Batt}$ increases somewhat.

The line resistance $Ri_L$ in series with the battery internal resistance $Ri_{Batt}$ has a nominal resistance of 1 mOhm corresponding to the line length from the positive terminal of the motor vehicle battery to the connection terminal of the starter motor. This value is dependent on the temperature coefficient of the line material, i.e., generally, copper.

In all, this results in that a total resistance of about 6 to 7 mOhms is adjusted at higher temperatures greater than +10° C. and normal battery charge states. At lower temperatures and poorly charged motor vehicle battery, the total resistance increases to values of around 7 to 9 mOhms.

In order to avoid an uneconomical instantaneous measurement of the battery internal resistance $Ri_{Batt}$ which can only be carried out in a complicated manner in case of short load pulses since a corresponding measuring accuracy is achieved only with large measurement currents of about 100 A, a battery internal resistance $Ri_{Batt}$ of 6 mOhms can be assumed when the time for switching off the starter of the internal combustion engine is reached, because this resistance value covers the majority of possible cases of operation of the internal combustion engine at less than 10° C. and with a normal battery charge.

In every case, this assumption results in a reliable criterion for switching off, since a larger current $I_S$ is automatically estimated at low temperatures and a larger time window is therefore activated up to the switching off of the starter.

In order to eliminate the no-load voltage and other electric consumers when evaluating the voltage U as a signal proportional to the starter current, a first measurement of the voltage U is carried out after an initialization phase $t_{in}$ before the start of a relay pull-in phase of an engagement relay associated with the starter motor. It follows that:

$$U_0=U_{Batt}-I_{verb}0(Ri_{Batt}+Ri_L),$$

where $U_{Batt}$ represents the no-load voltage and $I_{Verb}$ represents a current of other electric consumers connected at the starting time. The voltage U_0 accordingly contains the battery no-load voltage minus the voltage drop across the electric consumers connected at this time. A necessary voltage window of 10 V to +13 V is given.

The main measurement of the voltage U is carried out after 150 ms after the main contact of the starter motor is closed, i.e., at time $t_0$. This gives:

$$U_1=U_{Batt}-I_{Verb}+I_S).(Ri_{Batt}+R_L).$$

The subtraction of the last equation gives the following voltage difference:

$$d_u=I_S(Ri_{Batt}+R_L),$$

where a resistance $R_x$=6 mOhms is used overall for the resistance value of $Ri_{Batt}+R_L$. This gives:

$$I_S=(U_0-U_1)/6 \text{ mOhms}.$$

Therefore, a necessary voltage window is 7 to +13 volts. In order to increase the accuracy of measurement, the secondary electric consumers operating at the starting process must be systematically detected and plotted over the entire time range of the starting process. The level and curve of the respective currents are crucial in this case because an elimination of the secondary electric consumers also takes place in some cases via a suitably dimensioned filter.

Time ranges, each of which corresponds to a time window in a phase of rising voltage U, are indicated by hatching in FIG. 3. The phase of rising voltage U corresponds to the phase of a falling starter current $I_S$ according to FIG. 1, which applies in a corresponding manner for the starter current $I_S$.

By comparing the resulting time periods with the characteristic lines associated with the internal combustion engine corresponding to the operating state, e.g., warm characteristic line or cold characteristic line, the switching off of the starter for the internal combustion engine results when the time period within a rising phase of the voltage U to time $t_A$ is exceeded.

An increase in the accuracy of determining the switch-off point $t_A$ when evaluating the voltage U as a signal proportional to the starter current can be achieved in that adjustment magnitudes specific to the motor vehicle in question, especially as regards the motor vehicle battery and the connection line to the connection terminal of the starter motor, are eliminated and temperature influences and service life influences have as little influence as possible on the determination of the switching off of the starter.

For this purpose, the voltage U is measured at the connection terminal of the starter motor, first at the time of the maximum value of the starter current $I_S$, that is current $I_1$ at time $t_1$ in which the voltage U reaches its minimum $U_{min}$. At this time, the inductive voltage component is zero (L*di/dt=0; di/dt=0) and the voltage component $U_{ista}$ resulting from a rotational speed of the starter motor is relatively small and not dependent on a temperature of the starter motor. This value equals 0.3 to 0.5 V over the entire possible temperature range.

Based on these side constraints, two equations can be formed for $U_{min}$ by which the starter current $I_S$ can be determined at this time at the connection terminal and the resistance can be determined from the battery internal resistance $Ri_L$:

$$I_{stag}=(U_{min}-U_{xx})/Ra$$

and $$R_{ig}=(U_{Batt}-U_{min})/I_S,$$

where Istag is the estimated maximum starter current, Ista is the simulated maximum starter current, $U_{Batt}$ is the no-load voltage of the motor vehicle battery, $U_{min}$ is the minimum voltage at the connection terminal of the starter motor, $U_{xx}$ is the brush voltage of the starter motor plus the induced voltage of the starter motor, $Ri_G$ is the estimated battery internal resistance $Ri_{Batt}$ plus the line resistance $Ri_L$, and Ra is the contact resistance plus a ground-side line resistance plus a winding resistance of the starter motor and a proportion attributed to the starter brushes.

The following table shows the results determined on the basis of a simulation in an assumed temperature range of −20° C. to +80° C. A balance point is +20° C. The parameters used in the table apply to a 1.8 kW starter motor with magnetic excitation.

| | | | | |
|---|---|---|---|---|
| Battery state | 12.0 | 12.0 | 11.5 | 11.1 |
| $U_{b0}$ [V] | 100 | 100 | 80 | 80 |
| charge state [%] | 4 | 5 | 6.3 | 8.1 |
| $Ri_{Batt}$ [mOhm] | | | | |
| Ambient temp. of starter T[° C.] | 80 | 20 | 0 | −20 |
| U30min [V] | 6.4 | 5.7 | 5.0 | 4.4 |
| Ista [A] | 1020 | 960 | 820 | 700 |
| Ri [mOhm] | 5.5 | 6.5 | 7.8 | 9.6 |
| Istag [A] | 1050 (1128) | 949 | 770 | 615 |
| Rig [mOhm] | 5.3(5.5) | 6.6 | 8.4 | 10.9 |
| Uista [V] | 0.4 | 0.5 | 0.32 | 0.29 |

What is claimed is:

1. A method of switching off a starter motor of an internal combustion engine which is engageable with the engine for cranking and switched off when the internal combustion engine runs by itself, comprising the steps of:

determining a curve of a starter current ($I_S$) of the starter motor;

providing a plurality of time characteristic lines which are dependent on the operating state of the internal combustion engine;

selecting one of the time characteristic lines ($t_A=f(I_S)$) on the basis of current maxima (I) on the curve of the starter current ($I_S$); and switching off the starter motor at a time ($t_A$) which is determined by evaluating the selected time characteristic line with a signal which is proportional to the starter current.

2. A method as defined in claim 1, and further comprising determining the time (t) with negative gradient during a ripple of the starter current ($I_S$) starting with current maxima ($I_2$, $I_4$ and $I_6$) during a downward curve of the starter current, and comparing the same with at least one permanently stored time characteristic line.

3. A method as defined in claim 1; and further comprising selecting the time characteristic line to be dependent on a temperature of the internal combustion engine.

4. A method as defined in claim 1; and further comprising evaluating gradients of the starter current after discounting a preliminary phase after a time ($t_O$).

5. A method as defined in claim 1; and further comprising evaluating a motor vehicle battery voltage (U) as a signal proportional to the starter current ($I_S$).

6. A method as defined in claim 1; and further comprising taking into account a battery internal resistance ($RI_{BATT}$) and a line resistance $RI_L$ when measuring a motor vehicle battery voltage U.

7. A method as defined in claim 1; and further comprising eliminating an influence of instantaneous electric consumers of a motor vehicle on a motor vehicle battery.

8. A method as defined in claim 1; and further comprising eliminating an influence of magnitudes specific to a motor vehicle in question, including a charge state of a battery and the temperature of the battery.

* * * * *